US010918932B2

(12) United States Patent
Warmouth et al.

(10) Patent No.: US 10,918,932 B2
(45) Date of Patent: Feb. 16, 2021

(54) MECHANICALLY-FASTENED TPU JAW PAD

(71) Applicant: KRANOS IP CORPORATION, Litchfield, IL (US)

(72) Inventors: Cortney Warmouth, Edwardsville, IL (US); Louis Anthony VanHoutin, Luka, IL (US); Vincent R. Long, St. Peters, MO (US)

(73) Assignee: Kranos IP Corporation, Litchfield, IL (US)

( * ) Notice: Subject to any disclaimer, the term of this patent is extended or adjusted under 35 U.S.C. 154(b) by 1057 days.

(21) Appl. No.: 14/663,950

(22) Filed: Mar. 20, 2015

(65) Prior Publication Data

US 2016/0270473 A1 Sep. 22, 2016

(51) Int. Cl.
*A63B 71/10* (2006.01)
*A42B 3/12* (2006.01)

(52) U.S. Cl.
CPC ..... *A63B 71/10* (2013.01); *A42B 3/127* (2013.01)

(58) Field of Classification Search
CPC ..... A42B 3/18; A42B 3/205; A63B 71/10
See application file for complete search history.

(56) References Cited

U.S. PATENT DOCUMENTS 3,843,970 A * 10/1974 Marietta ..... A42B 3/127 2/415
4,060,855 A 12/1977 Rappleyea
4,831,668 A * 5/1989 Schulz ..... A42B 3/127 2/414
4,980,110 A * 12/1990 Nelson ..... B29C 66/61 264/152
5,647,107 A * 7/1997 Brewster ..... G09F 7/00 24/713.6
6,370,699 B1 4/2002 Halstead et al.
6,934,971 B2 8/2005 Ide et al.
7,841,025 B1 * 11/2010 Fink ..... A42B 3/127 2/414
8,201,269 B2 * 6/2012 Maddux ..... A42B 3/127 2/424
9,121,744 B1 * 9/2015 Kwiatkowski ..... G01F 23/268
9,622,533 B2 * 4/2017 Warmouth ..... A42B 3/122
2011/0131695 A1 * 6/2011 Maddux ..... A42B 3/18 2/9

* cited by examiner

*Primary Examiner* — Alissa J Tompkins
*Assistant Examiner* — Brieanna Szafran
(74) *Attorney, Agent, or Firm* — Notaro, Michalos & Zaccaria P.C.

(57) ABSTRACT

A protective jaw pad for a sports helmet having a shell with at least one side area for covering at least part of the jaw of a wearer, the jaw pad including a first resilient shock absorbing member of thermoplastic polyurethane, the first member having a sheet portion with multiple hollow protrusions, tapering side walls of the protrusions extending substantially to an inside surface of the side area of the shell and being compressible for absorbing shocks applied to the shell. The pad includes a second resilient shock absorbing member. A plastic cover is removably attached to the first resilient shock absorbing member, and encases the second shock absorbing member. The plastic cover and the first shock-absorbing member are releasably attached by a hook and loop fastener. The first shock absorbing member has multiple slots for receiving a T-nut at a variety of locations therealong.

20 Claims, 9 Drawing Sheets

MECHANICALLY-FASTENED TPU JAW PAD

FIELD AND BACKGROUND OF THE INVENTION

The present invention relates generally to the field of protective equipment and, in particular, to a new and useful protective jaw pad for sports or other protective equipment, and most particularly to a jaw pad for football and other sports helmets.

Examples of jaw pads for helmets can be found, for example, in U.S. Pat. No. 4,060,855 to Rappleyea for PAD FOR PROTECTIVE HELMET; U.S. Pat. No. 6,370,699 to Halstead et al., for JAW PAD FOR HELMET; and U.S. Pat. No. 6,934,971 to Ide et al. for FOOTBALL HELMET.

Typical jaw pads are provided in one piece with all of the parts fixed together, such as by sealing. This presents a practical problem, especially in youth sports leagues, where helmets and padding are transferred frequently among athletes of different face widths. An entire jaw pad must be replaced if it projects too far inward to properly fit a wider-faced athlete (such as a lineman). Similarly, the entire jaw pad unit must be replaced if it is not wide enough to secure a thinner-faced athlete (such as a quarterback or wide receiver).

In addition to the expense of having the entire jaw pad replaced, there is also the consideration of the time and effort needed to entirely remove the jaw pad from the helmet. In the past, this problem was addressed by securing the jaw pad by snaps only for ease of removal from, and installation in, the inside of the helmet shell.

A need remains for a protective jaw pad that provides optimal shock absorption characteristics, has a high like likelihood of remaining attached to the helmet, even in the event of strong impact. There is also a need for a jawpad which facilitates convenient and economic way of retrofitting a helmet when it is transferred among athletes of varying face widths.

SUMMARY OF THE INVENTION

It is an object of the present invention to provide a protective jaw pad for equipment such as a helmet having a shell, the pad including a first resilient shock absorbing member having a sheet portion with a plurality of hollow protrusions, tapering side walls of the protrusions being compressible for absorbing shocks applied to the shell. The pad includes a second resilient shock absorbing block, a cover encasing the second member only, and a plurality of fasteners that removably connect the jaw pad to an inner surface of the shell that is near the wearer's jaw when the shell is worn.

Another object of the invention is to provide a protective jaw pad with shock absorbing components made of thermoplastic polyurethane (TPU).

Another object is to provide a jaw pad whose parts may be readily separable for facilitating retrofitting.

With these objects in view, the present invention is directed to a protective jaw pad for a sports helmet having a shell with at least one side area for covering at least part of the jaw of a wearer, the jaw pad including a first resilient shock absorbing member of thermoplastic polyurethane, the first member having a sheet portion with multiple hollow protrusions, tapering side walls of the protrusions extending substantially to an inside surface of the side area of the shell and being compressible for absorbing shocks applied to the shell. The pad includes a second resilient shock absorbing member. A plastic cover is removably attached to the first resilient shock absorbing member, and encases the second shock absorbing member. The plastic cover and the first shock-absorbing member are releasably attached by a hook and loop fastener. The first shock absorbing member has multiple slots for receiving a T-nut at a variety of locations therealong. Multiple fasteners removably connect the jaw pad to the shell by at least some of the protrusions.

The present protective jaw pad has a first shock absorbing member made of one piece of resilient thermoplastic polyurethane. The first shock absorbing member has a sheet portion with a coverage area adapted for overlying at least part of the side portion of the helmet, and multiple hollow protrusions made as one piece with the sheet portion and distributed around the coverage area. The protrusions each have a large diameter base opening into the sheet portion, a small diameter closed and flat crest spaced from the base and substantially engaging an inner surface of the side portion of the helmet, and a tapering side wall extending from the sheet portion to the crest. Each tapering side wall is compressible for absorbing shocks applied to the shell. The bases are spaced from each other for distributing shock absorbing effects of the protrusions around the coverage area of the sheet portion.

The protective pad also has a second shock absorbing member extending over the coverage area and adapted to face the wearer's jaw for further absorbing shocks applied to the shell. The second shock absorbing member has the same shape as the sheet portion of the first shock absorbing member for covering the sheet portion of the first shock absorbing member.

The protective jaw pad also includes a cover of resilient elastomer encasing the second shock absorbing member and being removably fixed around its perimeter to a perimeter of the sheet portion of the first shock absorbing member for connecting the first and second shock absorbing members to each other.

The protective jaw pad also includes multiple spaced fasteners removably connecting the jaw pad to an inner surface of the side portion at at least some of the protrusions.

The tapering side walls of the protrusions of the first shock absorbing member have a first length for spacing the sheet portion from the shell by at least the first length.

The second shock absorbing member includes OMALON material and VN 1000 material.

The first shock absorbing member has a durometer of 80 shore A to 100 shore A.

The pad is typically L-shaped and extends substantially along a perimeter of the side portion of the helmet.

The multiple fasteners are each a female and male snap, with one of the female and male snap of each fastener being fixed to one of the protrusion and the other of the female and male snap of each fastener being connected to the inner surface of the side portion of the helmet.

The cover of resilient elastomer encasing the second shock absorbing member is removably fixed around its perimeter to a perimeter of the sheet portion of the first shock absorbing member by a hook and loop fastener.

The first shock absorbing member has a raised portion defining at least one slot.

In certain embodiments the raised portion may have a first slot, a second slot and a third slot.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
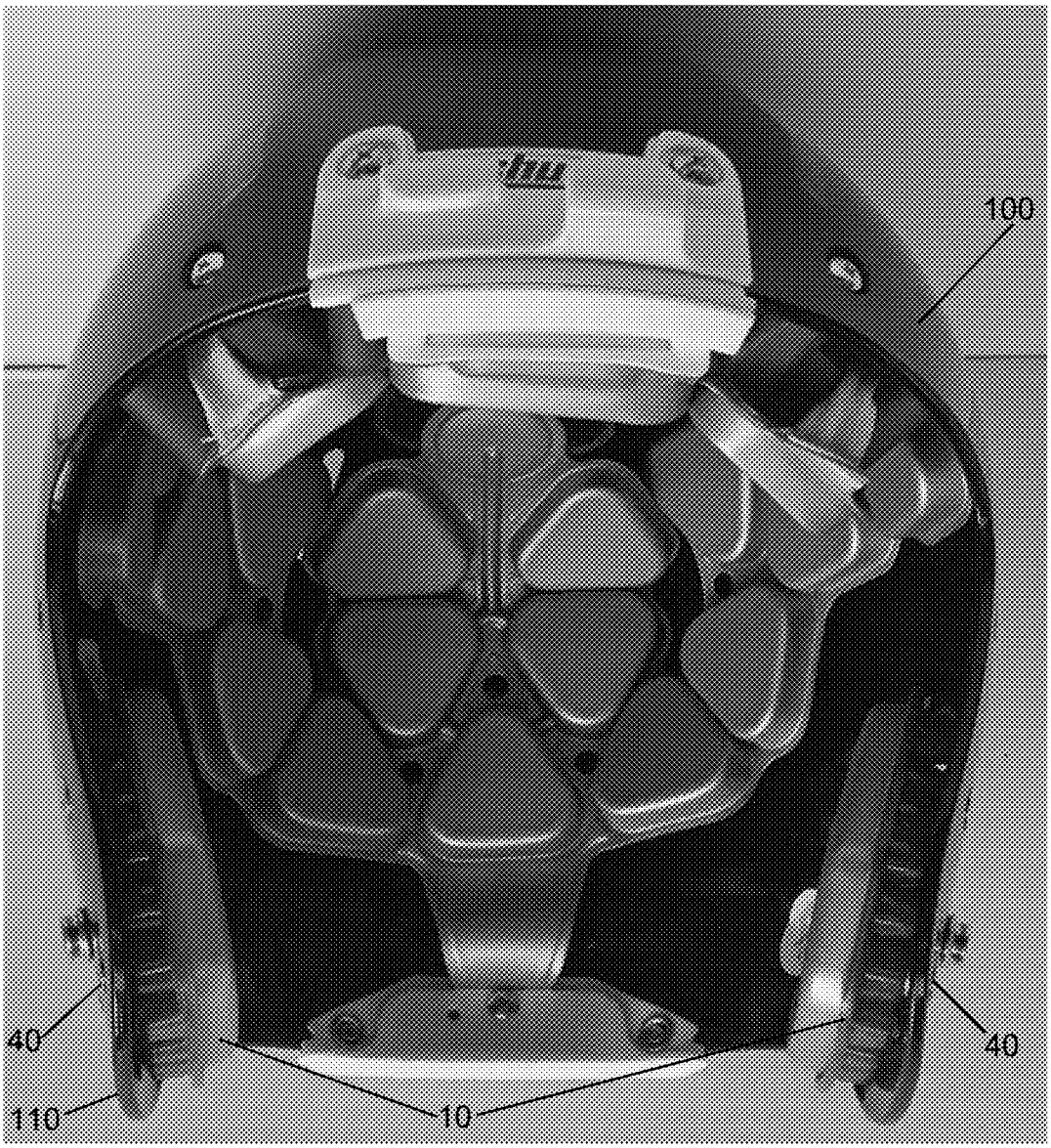
FIG. 1 is a front elevational view of a pair of protective jaw pads of the invention connected to the inner surface of the shell of a football helmet.

Referring now to the drawings, FIG. 1 shows a pair of elongated generally L-shaped protective jaw pads 10 for protective equipment such as a football helmet 100, having a hard plastic shell 110 for extending to the side of a wearer's jaw. The generally L-shape for the coverage area of each pad 10 (the left being an mirror image of the right) has been selected to better mimic the shape of the wearer's jaw that includes a generally horizontal mandible that carries the lower teeth, and a generally vertical ramus that hinges the jaw to the temporal bone of the wearer's skull.

As best seen in FIGS. 2-5, each pad 10 comprises a first shock absorbing member 12 of resilient, preferably TPU or thermoplastic polyurethane, elastomer. The first shock absorbing member 12 is formed, preferably by injection molding, and has a planar sheet portion 14 with a generally L-shaped coverage area adapted for overlying at least part of a side of a jaw of a wearer of the equipment, and a plurality of hollow protrusions 16 made as one piece with the sheet portion 14 and distributed around the coverage area. As best seen in FIGS. 2-5, the protrusions 16 each have a large diameter open base 16*a* opening into the sheet portion 14, a small diameter, preferably closed and preferably flat, crest 16*b* spaced from the base, and a tapering side wall 16*c* extending from the sheet portion 14 to the crest 16*b*.

Each tapering side wall 16*c* is compressible for absorbing shocks applied to the shell 110 and the bases 16*a* are spaced from each other for distributing shock absorbing effects of the protrusions 16 around the coverage area of the sheet portion 14.

Each pad 10 also includes a second shock absorbing member 20 of resilient elastomer that overlies the first shock absorbing member 12 and which also extends over the coverage area for further absorbing shocks applied to the shell. A cover 30 of resilient elastomer encases the second shock absorbing member 20. A plurality of fasteners, such as female snaps 38, removably connect each jaw pad 10 to the shell 110 via corresponding male snaps 40 in the shell 110.

Referring to FIGS. 1-5, the crests 16*b* of the protrusions 16 are closer to the shell 110 than the sheet portion 14 of the first shock absorbing member 14 to compress as a sudden force or impact is applied to the shell 110. To this end, the tapering side walls 16*c* of the protrusions 16 of the first shock absorbing member 12 have a first length for spacing the sheet portion 14 from the shell 110 by at least the first length to absorb the shock. The second shock absorbing member 20 is a resilient shock-absorbing block having an inner surface corresponding to, and extending over the coverage area of the sheet portion 14, on a side of the sheet portion that is opposite from the protrusions 16, and therefore close to the wearer's jaw. The second shock absorbing member 20 has an opposite outer surface and side walls that are covered by the cover 30.

Figure 4:
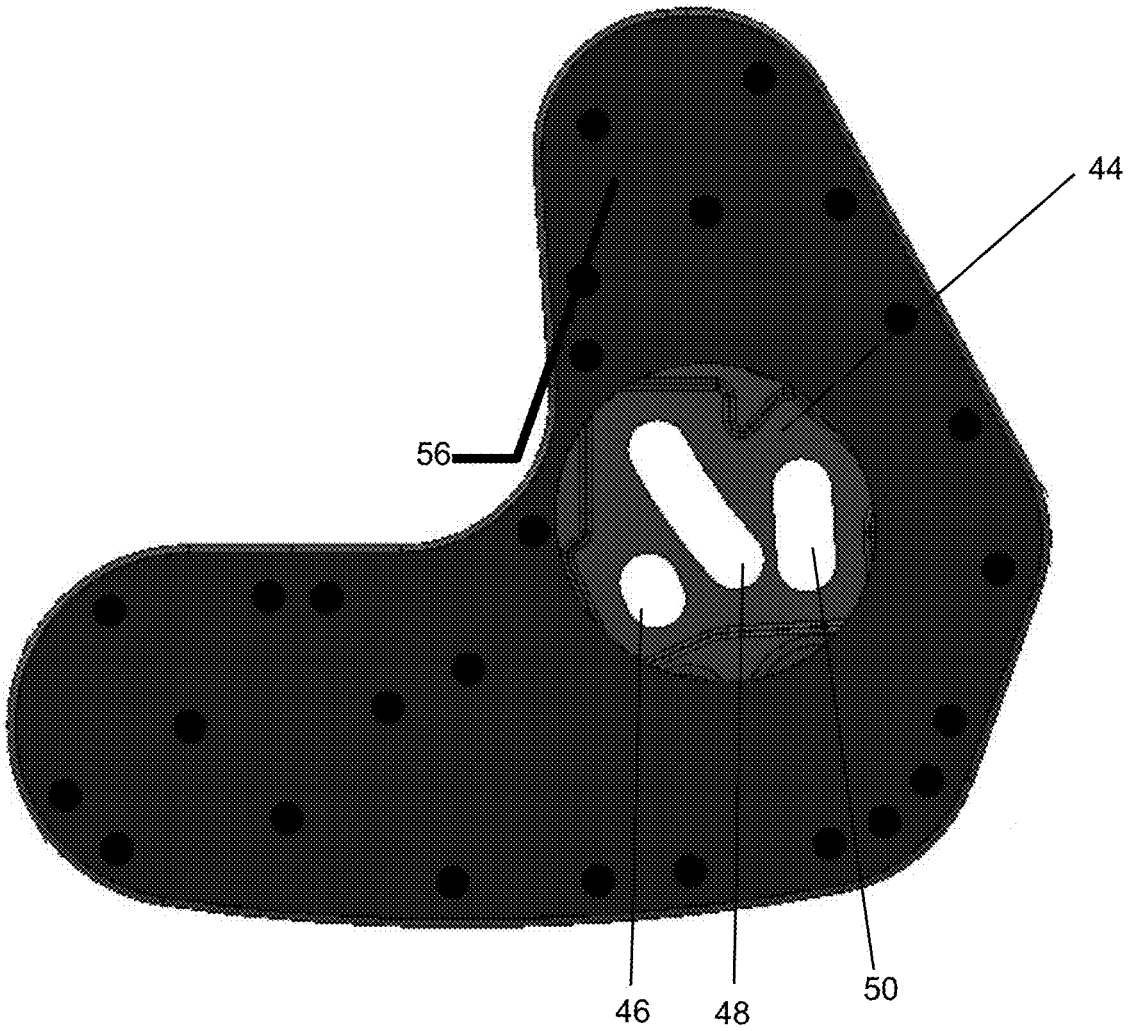
FIG. 4 is an inside plan view of a first shock absorbing member of the left jaw pad, showing the loop tape welded thereto.
Figure 6:
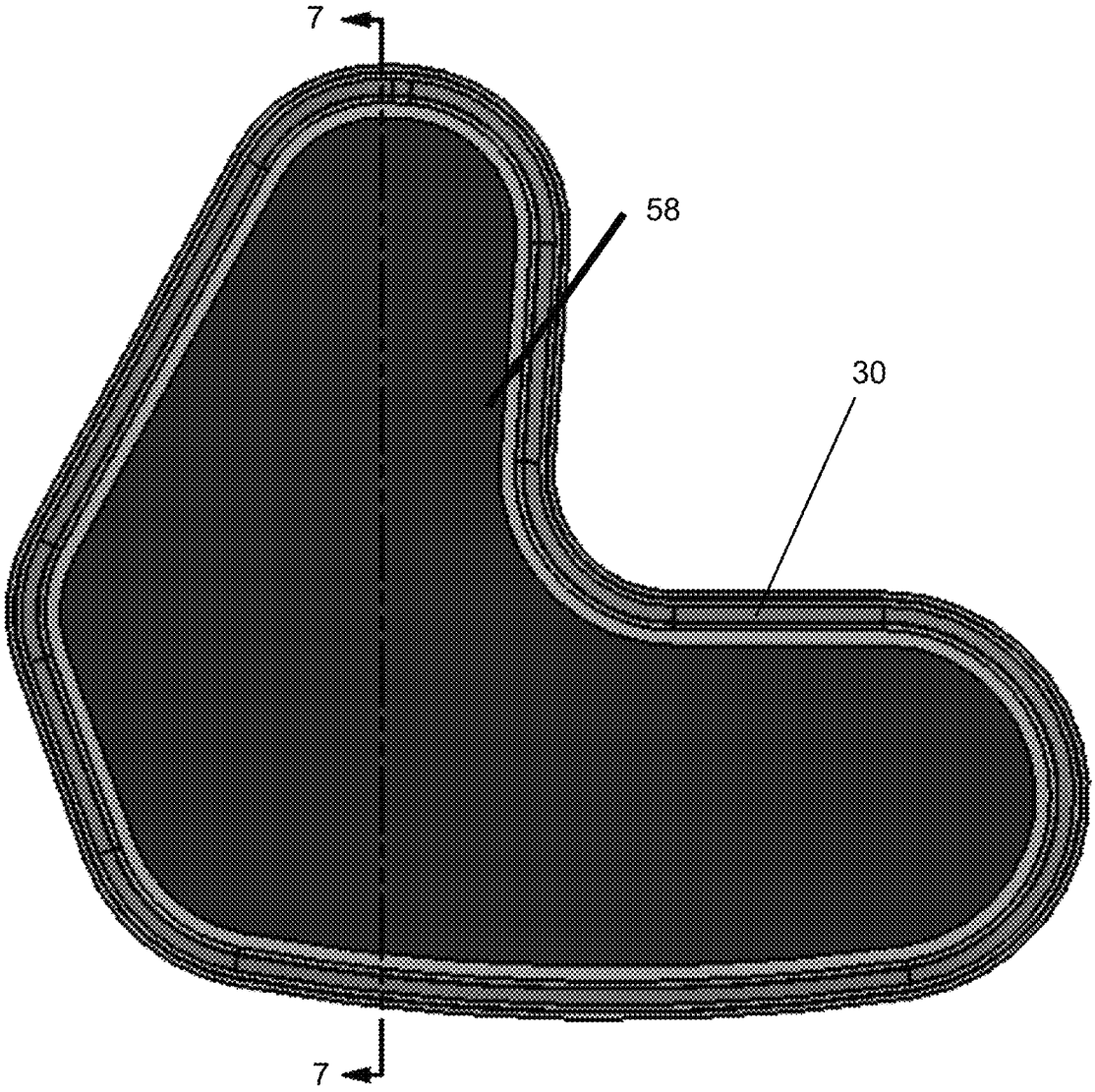
FIG. 6 is an inside plan view of the cover of a right jaw pad, showing the hook tape welded thereto.
Figure 7:
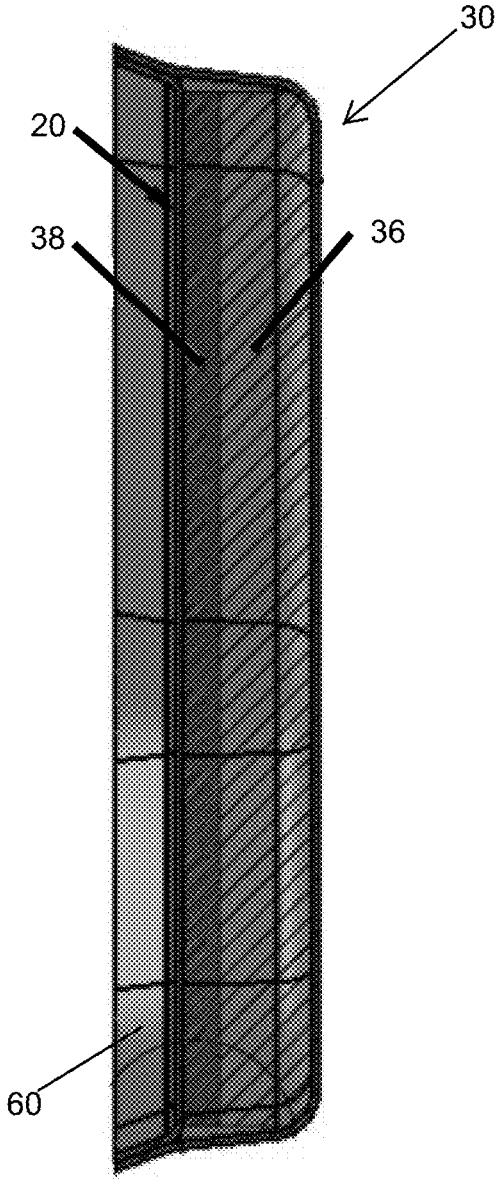
FIG. 7 is a sectional view of the cover of a right jaw pad of FIG. 6, taken along line 7-7 of FIG. 6.
Figure 8:
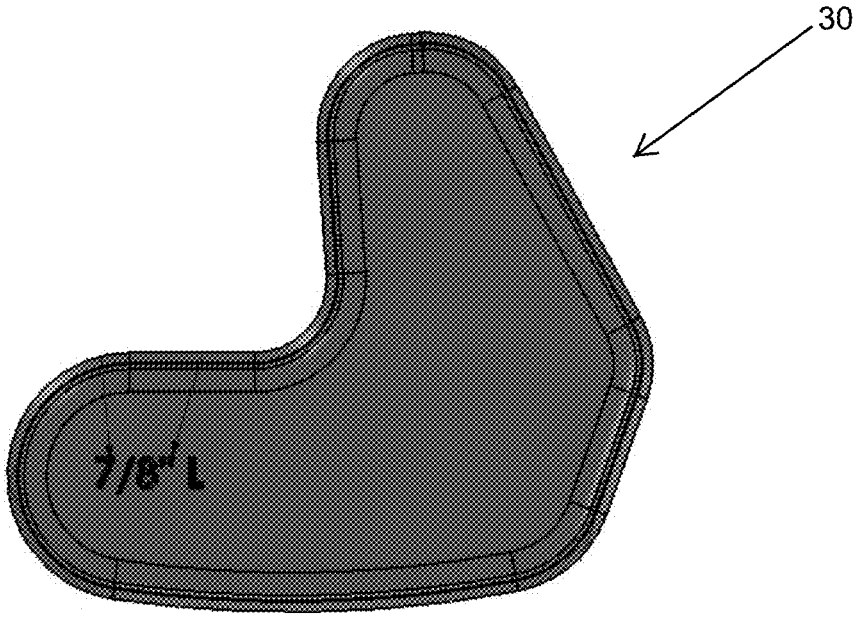
FIG. 8 is an outside plan view of the cover of a left jaw pad.
Figure 9:
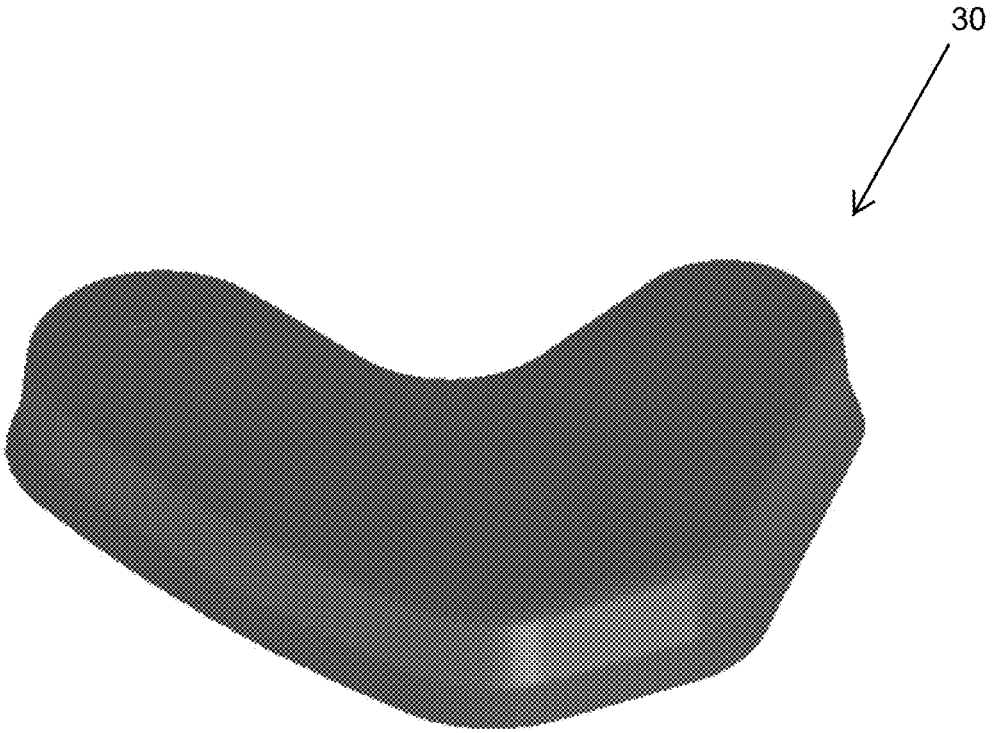
FIG. 9 is a perspective view of the cover of the left jaw pad shown in FIG. 8.

The cover 30 has a top shell 32, sealed along its perimeter to the perimeter of a base 34. The base 34 of the cover 30 is releasably joined to a perimeter of the sheet portion 14 by any convenient means. In typical embodiments, a hook and loop fastener is employed. As shown in FIG. 4, loop tape 56 is typically provided on the side of the sheet portion 14 directly opposite the cover 30, and, as shown in FIG. 6, hook tape 58 is provided on the side of the cover 30 directly opposite the sheet portion 14. As seen in FIG. 7, the cover 30 has a lip 60 which extends over the perimeter of the first shock absorbing member 12, when the first shock absorbing member 12 and the cover 30 are fixed together.

The second shock absorbing member 20 is preferably composed of a layer Omalon material 36 and a layer of VN 1000 material 38. The VN 1000 material 38 is a denser material provided to reduce discomfort from the protrusions 16.

The first shock absorbing member 12 is preferably made of thermoplastic polyurethane and having a durometer of 80 shore A to 100 shore A, and most preferably 90 shore A. The cover 30 is preferably an elastomeric material known as Bayer U-65A 10, or equivalent, that has been thermoformed or injection molded. Bayer U-65A 10 is a TPU material.

Figure 2:
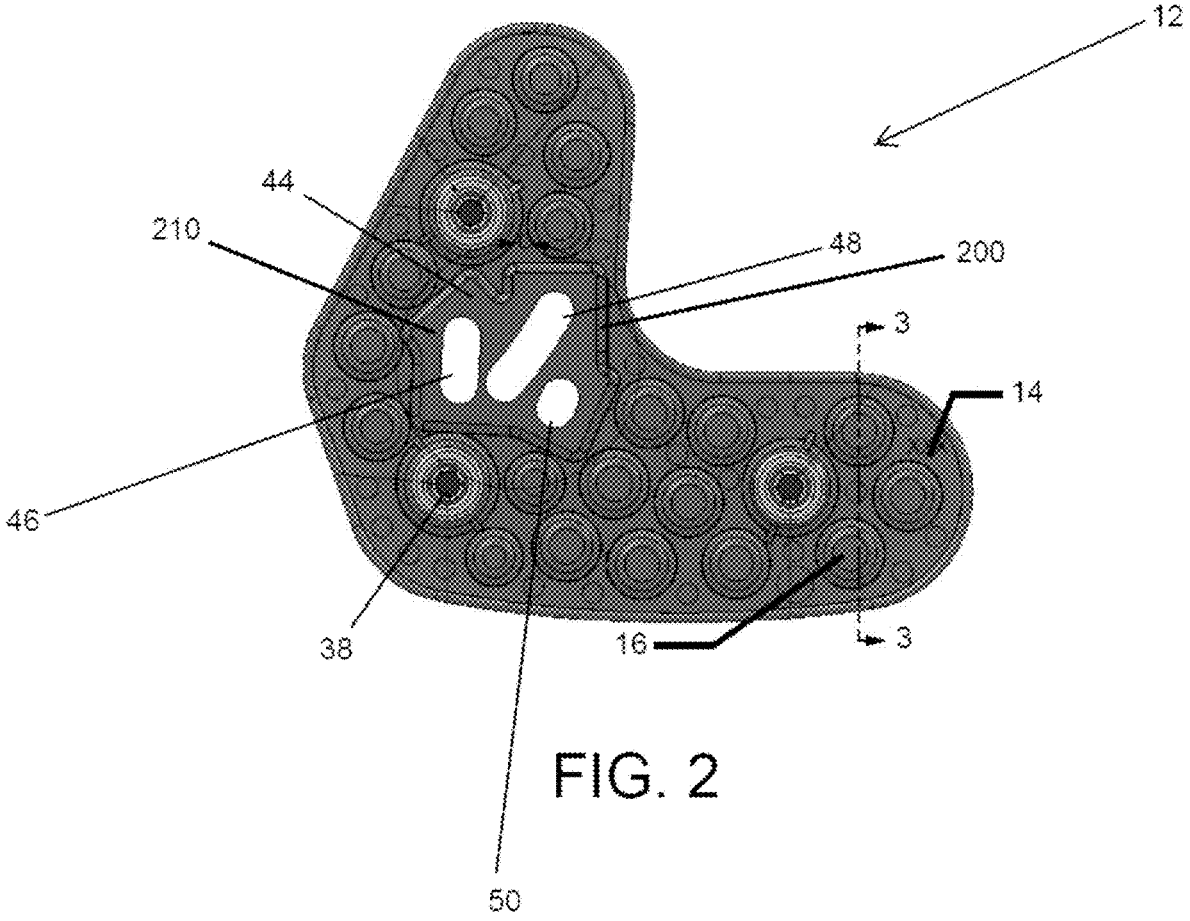
FIG. 2 is an inside plan view of a first shock absorbing member of the right jaw pad.

As shown in FIG. 2, three female snaps 38 are spaced along the coverage area, e.g. at the corners of a triangle, by being fixed to selected locations of the first shock absorbing member 12, corresponding to crests 16*b* of protrusions of the first shock absorbing members 12.

Figure 5:
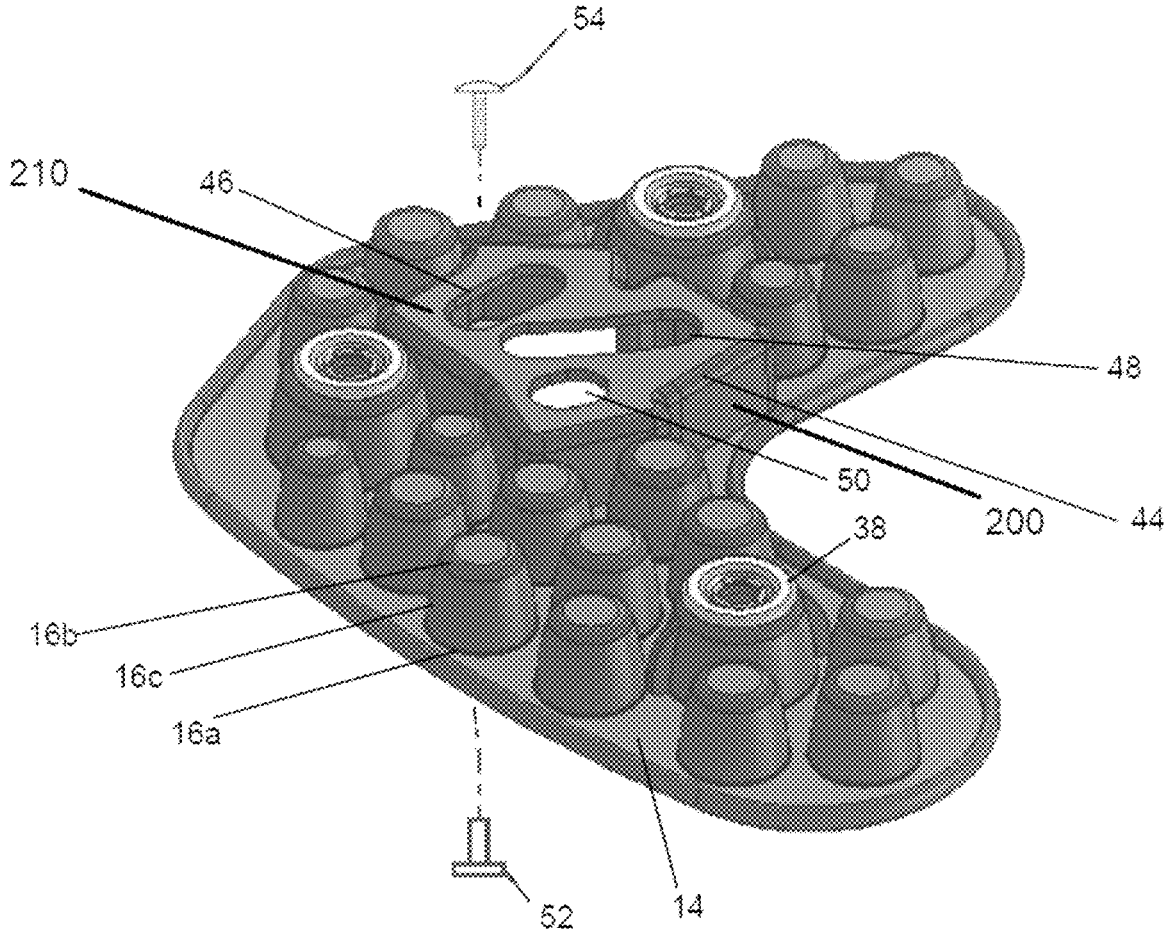
FIG. 5 is a perspective view of the first shock absorbing member of the left jaw pad shown in FIG. 4.

As shown in FIGS. 2, 4 and 5, the first shock absorbing member 12 also includes a raised portion 44, which includes a first slot 46, a second slot 48, and third slot 50. As shown, raised portion 44 is made as one piece with the sheet portion 14 of the first shock absorbing member 12 and has walls 200 (only one wall is numbered in the Figures) rising from the sheet portion 14 to a roof 210 spaced apart from the sheet portion 14 by the walls 200. Slots 46, 48, 50 are formed in roof 210 of raised portion 44. The slots are adapted to receive a T-nut 52 and screw 54 for further securement of the jaw pad 10 to the helmet shell 110. This relieves the pressure on the snaps 40, 42 and also helps to keep the jaw pad 10 in a desired position.

Figure 3:
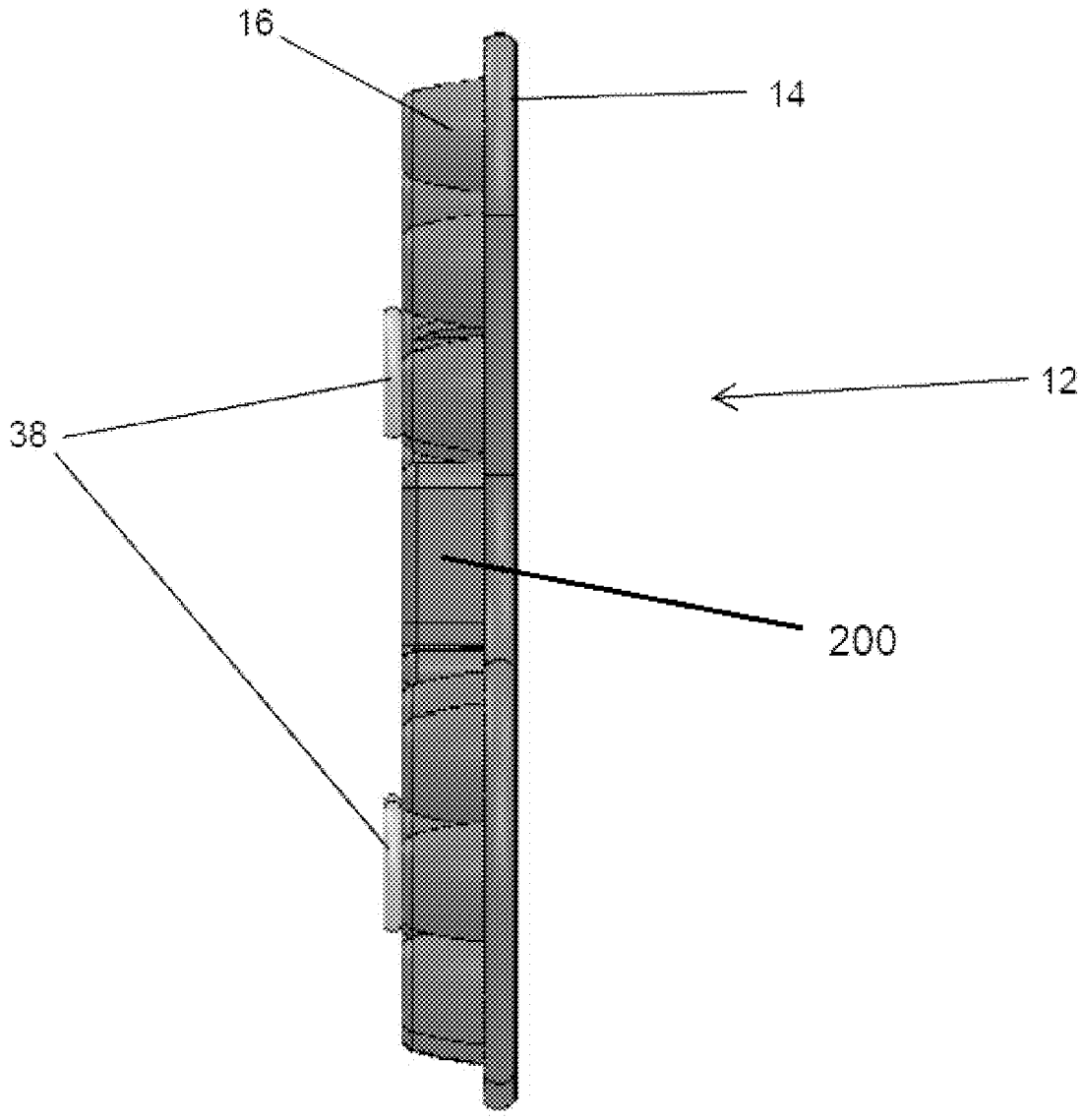
FIG. 3 is a sectional view of the first shock absorbing member of the right jaw pad of FIG. 2, taken along line 3-3 of FIG. 2.

In the typical embodiment shown in FIGS. 1-3 three slots are shown. However, more or fewer slots may be provided while remaining within the scope of the invention.

The three-slot embodiment shown allows for multiple convenient positions for locating the T-nut 52 and, therefore, multiple options for positioning the jaw pad 10. For example, the second slot 48 shown allows for the T-nut 52 to be located at at least three positions therealong. The first and third slots 46, 50 each provide for at least two positions for the T-nut 52. Thus, the present invention provides at least 12 locations at which the T-nut 52 may be located.

In typical embodiments, the three slots 46, 48, 50 have a width in the range of 0.15 to 0.30 inches, and preferably 0.23 inches. The first 46 slot is typically in the range of 0.40 to 0.60 inches long and preferably 0.53 inches long. The second slot 48 is typically in the range of 0.5 to 0.90 inches long, and preferably 0.75 inches long. The third slot 50 is typically in the range of 0.20 to 0.40 inches long, and preferably 0.30 inches long.

In certain embodiments, such as those shown in FIGS. 2, 4 and 5, at least two of the axes of the first slot 46, the second slot 48 and the third slot 50 intersect.

However, it is within the scope of the invention for the first slot 46, the second 48 slot, and the third slot 50 to be parallel.

It is within the scope of the invention for at least one of the slots 46, 48, 50 to have a slight curvature.

Although a preferred use of the jaw pad of the invention is in football helmets, jaw protective pads of the invention can be used in various other sports helmets such as those for baseball, lacrosse, hockey, bicycling, motor cycling, climbing, car, boat and airplane operation, and other motor racing and operation, and for non-sport helmets such as for construction workers or other crash helmets or headgear where protection of the jaw is desired, or for other protective equipment for protecting a body part from impact by providing an impact protective pad.

The designations inside, outside, top, bottom, first, second, etc, are used for convenience only to differentiate the various parts of the invention and do not indication a limitation to the scope of the invention.

While specific embodiments of the invention have been shown and described in detail to illustrate the application of the principles of the invention, it will be understood that the invention may be embodied otherwise without departing from such principles.

What is claimed is:

1. A protective jaw pad in combination with a sports helmet having a hard plastic shell with at least one side portion adapted to extend to a side of a wearer's jaw, the pad comprising:

a first shock absorbing member made of one piece of resilient thermoplastic polyurethane, the first shock absorbing member having a sheet portion with a coverage area adapted for overlying at least part of the at least one side portion, and a plurality of hollow protrusions made as one piece with the sheet portion and distributed around the coverage area, the protrusions each having a large diameter base opening into the sheet portion, a small diameter closed and flat crest spaced from the base and engaging an inner surface of the at least one side portion, and a tapering side wall extending from the sheet portion to the crest, each tapering side wall being compressible for absorbing shocks applied to the at least one side portion and the bases being spaced from each other for distributing shock absorbing effects of the protrusions around the coverage area of the sheet portion;

a second shock absorbing member extending over the coverage area and adapted to face the wearer's jaw for further absorbing shocks applied to the at least one side portion, the second shock absorbing member having the same shape as the sheet portion of the first shock absorbing member for covering the sheet portion of the first shock absorbing member; and a raised portion on the first shock absorbing member, the raised portion comprising walls rising from the sheet portion to a roof spaced apart from the sheet portion by the walls, the roof defining at least one slot having a length for receiving a T-nut at a variety of locations therealong whereby multiple options for positioning the jaw pad are provided;

wherein the raised portion comprises a first slot, a second slot and a third slot.

2. The combination of claim 1, wherein the first shock absorbing member has a durometer of 80 shore A to 100 shore A.

3. The combination of claim 1, wherein the pad is L-shaped and extends along a perimeter of the side portion.

4. The combination of claim 1, wherein the first shock absorbing member has a durometer of 80 shore A to 100 shore A and the pad is L-shaped and extends along a perimeter of the at least one side portion.

5. The combination of claim 1, wherein the first slot, the second slot and the third slot each have a width in the range of 0.15 to 0.30 inches.

6. The combination of claim 5, wherein the first slot, the second slot and the third slot each have a width of 0.23 inches.

7. The combination of claim 1, wherein the first slot has a length in the range of 0.40 to 0.60 inches.

8. The combination of claim 7, wherein the first slot has a length of 0.53 inches.

9. The combination of claim 1, wherein the second slot has a length in the range of 0.50 to 0.90 inches.

10. The combination of claim 9, wherein the second slot has a length of 0.75 inches.

11. The combination of claim 1, wherein the third slot has a length in the range of 0.20 to 0.40 inches.

12. The combination of claim 11, wherein the third slot has a length in the range of 0.30 inches.

13. The combination of claim 1, wherein the first slot, the second slot and the third slot are parallel.

14. The combination of claim 1, wherein at least two of the axes of the first slot, the second slot and the third slot intersect.

15. The combination of claim 1, wherein at least one of the first slot, the second slot and the third slot to have a slight curvature.

16. The combination of claim 1 wherein the tapering side walls of the protrusions of the first shock absorbing member have a first length for spacing the sheet portion from the at least one side portion by at least the first length.

17. The combination of claim 1 wherein the second shock absorbing member is a combination, two-layer member, said combination two-layer member includes a first layer and a second layer, wherein the first layer is a foam material and the second layer is a denser material than the first layer.

18. The combination of claim 1 further comprising a cover of resilient elastomer encasing the second shock absorbing member.

19. The combination of claim 18, wherein the cover of resilient elastomer encasing the second shock absorbing member is removably fixed around its perimeter to a perimeter of the sheet portion of the first shock absorbing member by a hook and loop fastener.

20. A protective jaw pad in combination with a sports helmet having a hard plastic shell with at least one side portion adapted to extend to a side of a wearer's jaw, the pad comprising:

a first shock absorbing member made of one piece of resilient thermoplastic polyurethane, the first shock absorbing member having a sheet portion with a coverage area adapted for overlying at least part of the at least one side portion, and a plurality of hollow protrusions made as one piece with the sheet portion and distributed around the coverage area, the protrusions each having a large diameter base opening into the sheet portion, a small diameter closed and flat crest spaced from the base and engaging an inner surface of the at least one side portion, and a tapering side wall extending from the sheet portion to the crest, each tapering side wall being compressible for absorbing shocks applied to the at least one side portion and the bases being spaced from each other for distributing shock absorbing effects of the protrusions around the coverage area of the sheet portion;

a second shock absorbing member extending over the coverage area and adapted to face the wearer's jaw for further absorbing shocks applied to the at least one side portion, the second shock absorbing member having the same shape as the sheet portion of the first shock absorbing member for covering the sheet portion of the first shock absorbing member; and a raised portion on the first shock absorbing member, the raised portion comprising walls rising from the sheet portion to a roof spaced apart from the sheet portion by the walls, the roof defining at least one slot having a length for receiving a T-nut at a variety of locations therealong whereby multiple options for positioning the jaw pad are provided;

a plurality of spaced fasteners removably connecting the jaw pad to an inner surface of the side portion at at least some of the protrusions;

wherein the plurality of fasteners are each a female and male snap, with one of the female and male snap of each fastener being fixed to one of the protrusion and the other of the female and male snap of each fastener being connected to the inner surface of the at least one side portion.

* * * * *